US007909088B2

(12) United States Patent
O'Malley et al.

(10) Patent No.: US 7,909,088 B2
(45) Date of Patent: Mar. 22, 2011

(54) MATERIAL SENSITIVE DOWNHOLE FLOW CONTROL DEVICE

(75) Inventors: Edward J. O'Malley, Houston, TX (US); Bennett M. Richard, Kingwood, TX (US)

(73) Assignee: Baker huges Incorporated, Houston, TX (US)

( * ) Notice: Subject to any disclaimer, the term of this patent is extended or adjusted under 35 U.S.C. 154(b) by 431 days.

(21) Appl. No.: 11/642,423

(22) Filed: Dec. 20, 2006

(65) Prior Publication Data

US 2008/0149323 A1 Jun. 26, 2008

(51) Int. Cl.
*E21B 43/12* (2006.01)

(52) U.S. Cl. ..... 166/53; 166/319

(58) Field of Classification Search ..... 166/53, 166/319, 227, 386

See application file for complete search history.

(56) References Cited

U.S. PATENT DOCUMENTS

| | | | |
|---|---|---|---|
| 3,420,363 | A | 1/1969 | Blickensderfer |
| 3,918,523 | A | 11/1975 | Stuber |
| 4,137,970 | A | 2/1979 | Laflin et al. |
| 4,612,985 | A | 9/1986 | Rubbo et al. |
| 4,640,354 | A | 2/1987 | Boisson |
| 4,862,967 | A | 9/1989 | Harris |
| 4,919,989 | A | 4/1990 | Colangelo |
| 4,936,386 | A | 6/1990 | Colangelo |
| 4,990,545 | A | 2/1991 | Hourai et al. |
| 5,048,605 | A | 9/1991 | Toon et al. |
| 5,049,591 | A | 9/1991 | Hayashi et al. |
| 5,145,935 | A | 9/1992 | Hayashi |
| 5,195,583 | A | 3/1993 | Toon et al. |
| 5,199,497 | A | 4/1993 | Ross |
| 5,558,153 | A | 9/1996 | Holcombe et al. |
| 5,687,795 | A | 11/1997 | Patel et al. |
| 5,906,238 | A | 5/1999 | Carmody et al. |
| 6,032,733 | A | 3/2000 | Ludwig et al. |
| 6,073,692 | A | 6/2000 | Wood et al. |
| 6,354,379 | B2 | 3/2002 | Miszewski et al. |
| 6,425,443 | B1 | 7/2002 | Hill et al. |
| 6,583,194 | B2 | 6/2003 | Sendijarevic |
| 6,817,441 | B2 | 11/2004 | Murakami et al. |
| 6,834,725 | B2 | 12/2004 | Whanger et al. |
| 6,848,505 | B2 | 2/2005 | Richard et al. |
| 6,854,522 | B2 | 2/2005 | Brezinski et al. |

(Continued)

FOREIGN PATENT DOCUMENTS

| | | |
|---|---|---|
| DE | 3700717 | 7/1988 |

(Continued)

OTHER PUBLICATIONS http://www.alchemycastings.com/lead-products/fusible.htm.

(Continued)

*Primary Examiner* — William P Neuder
(74) *Attorney, Agent, or Firm* — Steve Rosenblatt

(57) ABSTRACT

A screen section has a valve assembly to control flow through it. The valve is open and has a closure spring held compressed by a shape memory material that responds to the presence of a specific well fluid or fluids so that its property changes to allow the spring to deliver the stored potential energy to the valve member to close it when the specific well fluid or fluids are detected. The preferred material is a shape memory polymer that, for example, is sensitive to the presence of water or methane and gets softer to release the potential energy source to operate the downhole tool.

18 Claims, 1 Drawing Sheet

U.S. PATENT DOCUMENTS

| | | | | |
|---|---|---|---|---|
| 6,976,542 | B2 | 12/2005 | Henriksen et al. | |
| 2001/0001420 | A1 | 5/2001 | Miszwenski et al. | |
| 2003/0116315 | A1 | 6/2003 | Wellington et al. | |
| 2004/0020662 | A1 | 2/2004 | Freyer | |
| 2004/0055760 | A1 | 3/2004 | Nguyen | |
| 2004/0118572 | A1 | 6/2004 | Whanger et al. | |
| 2004/0194971 | A1 | 10/2004 | Thomson | |
| 2004/0216887 | A1 | 11/2004 | Bertelsen | |
| 2004/0261990 | A1 | 12/2004 | Bosma et al. | |
| 2005/0067170 | A1 | 3/2005 | Richard | |
| 2005/0092363 | A1 | 5/2005 | Richard et al. | |
| 2005/0110217 | A1 | 5/2005 | Wood et al. | |
| 2006/0042798 | A1 | 3/2006 | Badalamenti et al. | |
| 2006/0175065 | A1 | 8/2006 | Ross | |
| 2007/0012434 | A1 | 1/2007 | Riggenberg | |
| 2007/0044962 | A1 | 3/2007 | Tibbles | |
| 2007/0125532 | A1 | 6/2007 | Murray | |
| 2007/0137865 | A1 | 6/2007 | Farrar et al. | |
| 2007/0144731 | A1 | 6/2007 | Murray | |
| 2007/0163777 | A1* | 7/2007 | Murray et al. | 166/179 |
| 2007/0246213 | A1 | 10/2007 | Hailey, Jr. | |
| 2007/0246225 | A1 | 10/2007 | Hailey, Jr. et al. | |

FOREIGN PATENT DOCUMENTS

| | | | |
|---|---|---|---|
| GB | 851365 | | 10/1960 |
| GB | 2328463 | | 2/1999 |
| GB | 2411918 | | 9/2005 |
| GB | 2416796 | | 2/2006 |
| GB | 2421527 | A | 6/2006 |
| GB | 2421746 | | 7/2006 |
| JP | 03166459 | | 12/1992 |
| JP | 07334115 | | 6/1997 |
| JP | 10235996 | | 2/2000 |
| WO | 9958809 | | 11/1999 |
| WO | 2004018836 | | 3/2004 |
| WO | 2005/035937 | A1 | 4/2005 |
| WO | 2005035937 | | 4/2005 |
| WO | 2006015277 | | 2/2006 |
| WO | 2007124374 | | 11/2007 |

OTHER PUBLICATIONS http://www.solders.com/low__melt__alloys.htm.

BE. Paul Bercegeay, et al., "A One-Trip Gravel Packing System", SPE 4771; Feb. 1974; 12 pages.

Stephen P. Mathis; Sand Management: A Review of Approaches and Concerns; SPE 82240; May 2003; 7 pages.

* cited by examiner

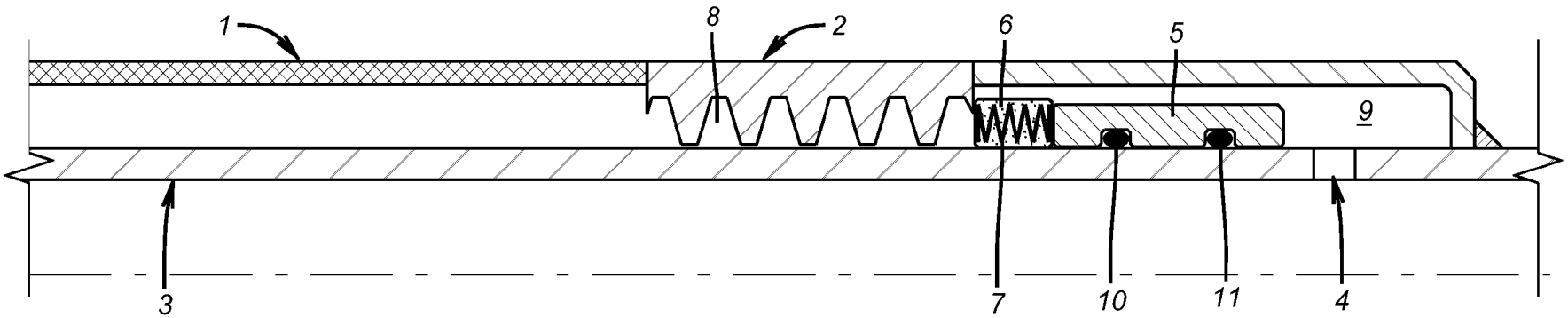
1
2
3
4
5
6
7
8
9
10
11

MATERIAL SENSITIVE DOWNHOLE FLOW CONTROL DEVICE

FIELD OF THE INVENTION

The field of the invention is downhole tools that can be actuated by a material that responds to the presence of certain well fluids so as to actuate a tool.

BACKGROUND OF THE INVENTION

Wells that are in production are prone to occasional production of undesirable water or unwanted gasses such as methane, for example. When these situations arise it is necessary to cut the production flow and take production from elsewhere in the wellbore or even to drill a new lateral to get away from the migration of those contaminants into the production string.

Typically, the production takes place through screens, with or without a gravel pack in the annulus around the screen. In the event of production of a contaminant, it is advantageous to cut off the production flow and to do it automatically at the initial detection of the presence of such a material.

The present invention has many applications and is suited to selectively cut off flow to a screen section where the foreign material is sensed. It can be employed with an Equalizer® Screen sold by Baker Oil Tools or with other tools. In the preferred embodiment a shape memory material that is sensitive to the presence of the undesired contaminant is used to hold in a check an energy source. Once the contaminant is detected the material properties of the shape memory material change and the potential energy is liberated to allow flow to be blocked. Those skilled in the art will appreciate that other applications or the reverse of the preferred operation are also envisioned and that the full scope of the invention is given by the claims that appear below.

SUMMARY OF THE INVENTION

A screen section has a valve assembly to control flow through it. The valve is open and has a closure spring held compressed by a shape memory material that responds to the presence of a specific well fluid or fluids so that its property changes to allow the spring to deliver the stored potential energy to the valve member to close it when the specific well fluid or fluids are detected. The preferred material is a shape memory polymer that, for example, is sensitive to the presence of water or methane and gets softer to release the potential energy source to operate the downhole tool.

BRIEF DESCRIPTION OF THE DRAWING

FIG. 1 is an assembly showing the use of the invention in a production screen application to selectively cut off flow through it when a selected material is present.

DETAILED DESCRIPTION OF THE PREFERRED EMBODIMENT

FIG. 1 illustrates a screen 1 that has a base pipe 3 behind it so that flow through the screen has to go through a spiral path 8 in housing 2 to reach a port 4. Housing 2 covers port 4 creating an annular space 9 in which is located a sliding sleeve 5 that has spaced apart seals 10 and 11. In the FIG. 1 position, the friction force of the seals 10 and 11 holds the sleeve 5 in position for run in and production through the screen 1. This happens because the sleeve 5 is in pressure balance in annular space 9. A source of potential energy, such as a spring 7 is preferably embedded or otherwise held compressed by a material 6 which is a part of the actuating component. The preferred material is of the type that changes physical properties or dimension when in the presence of a material that is sought to be excluded from flowing through the screen 1 in significant quantities. A shape memory material that is sensitive to a specific material or materials can be used as material 6. One of the materials that can trigger a physical property change can be water or methane gas or another fluid. When that material is produced, the phase change in material 6 makes it go soft so that the compressed spring 7 can extend and push the sleeve 5 to overcome the friction of seals 10 and 11 and cover the port 4. Those skilled in the art will appreciate that optionally a snap ring can jump into a groove in the base pipe 3 to lock the sleeve 5 in the closed position after it is shifted by the stored energy force, in the case of the preferred embodiment, being the spring 7.

Those skilled in the art will appreciate that the spring 7 can be replaced with other potential energy sources or that the material 6 itself can be the potential energy source and the sole actuating component. For example, the material 6 can be bentonite clay that swells in the presence of water and pushes the sleeve 5 to the closed position. Other known shape memory materials that get softer in the presence of the fluid sought to be excluded can be used or yet other materials that are not necessarily shape memory materials but behave in a way that allows a force to be created or released in their presence can also be used. Some materials for this service are certain epoxy resins that deteriorate in the presence of brine at temperature and pressure; or water swellable elastomers that become softer as a % of volumetric swell.

The same sleeve 5 can be made sensitive to more than one undesired material by using a plurality of different materials 6 sensitive to different fluids to actuate the same sleeve 5. Alternatively, the different screen sections can be made to selectively close in response to different undesired fluids whether liquid or gas being produced.

An advantage of the present invention is the ability to respond quickly and automatically when the undesired fluid appears and the sheer simplicity of the detection/actuation system which cuts off flow before an unacceptable amount of the contaminant is produced and has to be separated at the surface.

While the invention is described in the context of a valve for a screen section, it can be used in many applications downhole to close, or even open valves based on a sensed well condition specific to a target fluid. While on and off application is envisioned, the operation can also contemplate throttling and movement in opposed direction of sleeve 5 based on the level of the undesired material sensed as formation behavior is at times responsive to throttling to make the undesired material migrate to another portion of the well where it will not be produced. Other devices that could also be triggered by the presence of the unwanted fluid include such devices as packers or plugs, for example. While FIG. 1 shows a closure operation when the undesired material is produced, an override system can be in place to act on sleeve 5 to open it against the bias of spring 7 into a fully open or partially open position. This can be done by making the seals 10 and 11 different sized and getting pressure onto sleeve 5 through port 4 for example. This technique can be used to allow production to restart after the undesired material has migrated to another location and is not any longer being produced.

The above description is illustrative of the preferred embodiment and many modifications may be made by those skilled in the art without departing from the invention whose scope is to be determined from the literal and equivalent scope of the claims below:

The invention claimed is:

1. An actuating system for a downhole tool, comprising:

a body;

a movable component mounted on said body selectively positioned in a different position when the tool is operated, said movable component comprises at least one rigid valve member movable to selectively cover or uncover at least one port in said body; and an actuating component assembly mounted on said body comprising a retaining member that is sensitive to contact with at least one predetermined material selectively present outside said body downhole to change a physical property or dimension and thereby release a potential energy force sufficiently powerful to exclusively move said valve member with respect to said port and stored in a discrete component other than said retaining member said discrete component is disposed at least in part within said retaining member.

2. The system of claim 1, wherein:

said actuating component further comprises a potential energy source that is released on exposure to said predetermined material.

3. The system of claim 2, wherein:

said potential energy source comprises a spring.

4. The system of claim 1, wherein:

said at least one valve member comprises a plurality of valve members each actuated by a respective actuating component that is sensitive to the same predetermined material.

5. The system of claim 4, wherein:

said predetermined material comprises a fluid.

6. The system of claim 5, wherein:

said predetermined material comprises water or methane.

7. The system of claim 1, wherein:

said at least one valve member comprises a plurality of valve members each actuated by a respective actuating component, wherein said actuating components are sensitive to the different predetermined materials.

8. The system of claim 7, wherein:

at least one said predetermined material comprises a fluid.

9. The system of claim 8, wherein:

said predetermined materials comprise water and methane.

10. The system of claim 1, wherein:

an individual said valve member is actuated by an actuating component assembly response to a plurality of predetermined materials downhole.

11. The system of claim 1, wherein:

said valve member is integrated into a screen mounted to said body for control of flow through said screen.

12. The system of claim 1, wherein:

said actuating component assembly comprises at least one of a shape memory material or a swelling material.

13. The system of claim 12, wherein:

said actuating component assembly comprises a shape memory material.

14. The system of claim 13, wherein:

said potential energy source comprises a spring.

15. The system of claim 1, wherein:

said valve member movable between an open port and a closed port position on exposure of said actuating component assembly to said predetermined material.

16. The system of claim 15, wherein:

said valve member movable to a closed port position on exposure of said actuating component assembly to said predetermined material, whereupon said valve member is locked against further movement.

17. The system of claim 15, wherein:

said valve member is movable to at least one position between open and closed port depending on the extent of the presence of the predetermined material.

18. The system of claim 17, wherein:

said valve member is movable in opposed directions.

* * * * *